US005685685A

United States Patent [19]

Beckmann

[11] Patent Number: 5,685,685

[45] Date of Patent: Nov. 11, 1997

[54] TRANSFER STATION FOR BOBBIN-TYPE CIGARETTE PACKAGING MATERIAL

[75] Inventor: Harald Beckmann, Gevelsberg, Germany

[73] Assignee: Maschinenfabrik Alfred Schmermund GmbH & Co., Gevelsberg, Germany

[21] Appl. No.: 542,619

[22] Filed: Oct. 13, 1995

[30] Foreign Application Priority Data

Oct. 14, 1994 [DE] Germany ..... 44 36 716.3

[51] Int. Cl.[6] ..... B65H 19/00

[52] U.S. Cl. ..... 414/225; 414/911; 242/559.2

[58] Field of Search ..... 414/225, 732, 414/736, 908, 911; 242/554.3, 559, 559.2, 559.4

[56] References Cited

U.S. PATENT DOCUMENTS

| | | | |
|---|---|---|---|
| 3,870,244 | 3/1975 | Sarkisov et al. | 242/559.2 |
| 4,720,231 | 1/1988 | Pienta | 414/911 X |
| 4,744,711 | 5/1988 | Heitmann et al. | 414/911 X |
| 4,821,972 | 4/1989 | Grollimund et al. | 242/523.1 |
| 5,031,381 | 7/1991 | Focke | 242/559.2 X |
| 5,096,357 | 3/1992 | Galbani | 414/911 X |
| 5,226,778 | 7/1993 | Sekitani | 414/911 X |
| 5,362,191 | 11/1994 | Beckmann | 414/225 |
| 5,437,530 | 8/1995 | Beckmann | 414/911 X |

FOREIGN PATENT DOCUMENTS

| | | | |
|---|---|---|---|
| 0 166 841 | 11/1986 | European Pat. Off. . | |
| 0 405 150 | 1/1991 | European Pat. Off. . | |
| 539985 | 5/1993 | European Pat. Off. . | |
| 36 31 205 | 3/1988 | Germany . | |
| 37 44 105 | 7/1989 | Germany . | |
| 90 17 476.3 | 4/1992 | Germany . | |
| 41 42 256 | 6/1992 | Germany . | |
| 40 41 865 | 7/1992 | Germany . | |
| 42 29 389 | 3/1993 | Germany . | |
| 42 10 592 | 10/1993 | Germany . | |
| 43 04 734 | 8/1994 | Germany . | |
| 0024082 | 1/1990 | Japan | 414/736 |
| 4-327421 | 3/1993 | Japan . | |
| 5104136 | 4/1993 | Japan | 242/559.2 |
| 1315228 | 6/1987 | U.S.S.R. | 414/736 |
| 2167047 | 5/1986 | United Kingdom . | |
| 2244983 | 12/1991 | United Kingdom . | |

*Primary Examiner*—James W. Keenan
*Attorney, Agent, or Firm*—Chilton, Alix & Van Kirk

[57] ABSTRACT

Apparatus for transferring bobbins containing packaging material to, and/or removing the cores of empty bobbins from, a receiving device of a cigarette packaging machine includes a transfer station having a chassis, an axle mounted on the chassis for rotation about an axis angularly oriented with respect to the axes of incoming full bobbins, at least a first arm affixed to and angularly extending from the axle and a gripping device movably supported on each arm. Full and empty bobbins are transported to and from the transfer station with their axes of rotation oriented generally transverse to a movable support plate which may be positioned for cooperation with the gripping devices.

13 Claims, 2 Drawing Sheets

TRANSFER STATION FOR BOBBIN-TYPE CIGARETTE PACKAGING MATERIAL

BACKGROUND OF THE INVENTION

1. Field of the Invention

The present invention relates to the packaging of cigarettes and more particularly to the transfer of bobbins having packaging material wound thereon to a receiving device of a cigarette packaging machine. More specifically, this invention is directed to an automated transfer station for transferring bobbins to, and removing bobbin cores from, a cigarette packaging machine of the type having a plurality of bobbins of packaging material for continuous dispensing therefrom. Accordingly, the general objects of the present invention are to provide novel and improved apparatus and methods of such character.

2. Description of the Prior Art

Packaging machines employing one or more supply bobbins for packaging material in web format are well known in the art. In these machines, a web of packaging material is typically unwound from the supply bobbin and routed, via one or more rollers, to a remote location where product packaging occurs. To avoid the need to shut down the packaging machine during replacement of an exhausted bobbin of packaging material, packaging machines were developed employing a plurality of bobbins. These machines can be equipped with a splicing apparatus for automated transition from a nearly exhausted bobbin of packaging material to a full bobbin of packaging material with minimal interference of material dispensing operations. Such machines are capable of continuously supplying packaging material virtually indefinitely; that is, as long as the exhausted bobbins of packaging material are manually removed from the machine in timely fashion after a splicing operation and are manually replaced with full bobbins.

Since wholly manual replacement of exhausted bobbins is impractical in many environments, devices have been developed to aid manual replacement of the exhausted bobbins. One such apparatus is disclosed in German Patent DE-A-3,744,105. This device has a chassis with a column extending therefrom and a vertically displaceable sleeve. The sleeve is mounted on an axle which rotates about an axis oriented at an angle of approximately 45° to a horizontal plane. The device of German Patent DE-A-3,744,105 includes a bobbin receiving journal which is movable between a horizontal position and a vertical position. The receiving journal has manually actuable jaws for holding a bobbin. Accordingly, a user can securely clamp a bobbin onto the journal once it has been received by the journal. In order to replace a bobbin with this device, the bobbin, which normally lies on one side during transport, must first be manually lifted to a vertical position for transfer to a receiving journal. Since the packaging material used in packaging cigarettes is particularly flat, especially the tear-off strip of the transparent film, the device of German Patent 3,744,105 is not well suited for replacement of bobbins on cigarette packaging machines. Furthermore, this device suffers from the obvious drawback that it requires manual labor to effectuate bobbin replacement. Thus, while this device may aid bobbin replacement, it falls far short of fulfilling the need for automated replacement of bobbins bearing cigarette packaging material.

Other attempts at automating the bobbin replacement procedure have focused on transporting new bobbins from a remote location to the general vicinity of the packaging machine. For example, German Patent DE-A-4,210,592 discloses a system for delivering bobbins of material wherein a plurality of bobbins wound with packaging material are stored in a remote location. For distribution of the bobbins from the remote storage location to packaging machines, the system employs an elevated monorail and a plurality of trolleys which are powered by electric motors. Since these trolleys have a substantially horizontal base plate, the bobbins transported thereon can lie on their side during transport. This eliminates the need to lift the bobbins vertically from their horizontal storage positions as was necessary with previous devices. Further, in order to avoid interference caused by the use of several trolleys on a single elevated monorail, the system employs a plurality of rails and a switching mechanism which enable simultaneous operation of several trolleys. Thus, the overhead conveying system disclosed in German Patent DE-A-4,210,592 provides an effective means for transporting bobbins from a remote location to the general vicinity of a packaging machine. However, this conveying system does not provide for automated replacement of bobbins on a packaging machine. Thus, the need for an automated bobbin transferring apparatus has gone unfulfilled.

SUMMARY OF THE INVENTION

It is accordingly an object of the present invention to achieve the automated transport, removal and replacement of bobbins wound with webs of packaging material, and particularly cigarette packaging materials.

This and other objects and advantages of the present invention are provided, in one embodiment of apparatus in accordance with the invention, by providing an overhead conveyor system having a number of rails and a plurality of trolleys for transporting bobbins along the rails from a storage area to a transfer position. The invention also includes a chassis for mounting an axle and a turntable with at least one receiving journal thereon. The axle is mounted to the chassis for rotation about an axis which is oriented at a 45° angle to a plane defined by the conveyor system and has at least one arm extending from one end which moves between substantially horizontal and vertical positions when the axle is rotated. Finally, a gripping device for gripping bobbins is mounted on each arm.

To supply a bobbin using the transfer station of the present invention, a bobbin is first loaded onto a generally horizontally oriented base plate of a trolley and the trolley is driven along an overhead rail to the general vicinity of a receiving device of a cigarette packaging machine. The axle rotates to move the arm extending from the axle to the vertical position and the gripping device moves into engagement with the bobbin on the baseplate of the trolley. After the gripping device engages the bobbin, it moves along the length of the arm thereby raising the bobbin off of the base plate, and the axle is, once again, rotated until the arm has reached its horizontal position. At this point, the bobbin is axially aligned with a receiving journal on the turntable, and the gripping device moves along the arm until the bobbin is transferred onto the receiving journal. Finally, the gripping device releases the bobbin and moves toward the free end of the arm so that the bobbin can dispense packaging material and the turntable can rotate without interference from the gripping device.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several Figures and in which.

DETAILED DESCRIPTION OF THE DISCLOSED EMBODIMENT

Figure 1:
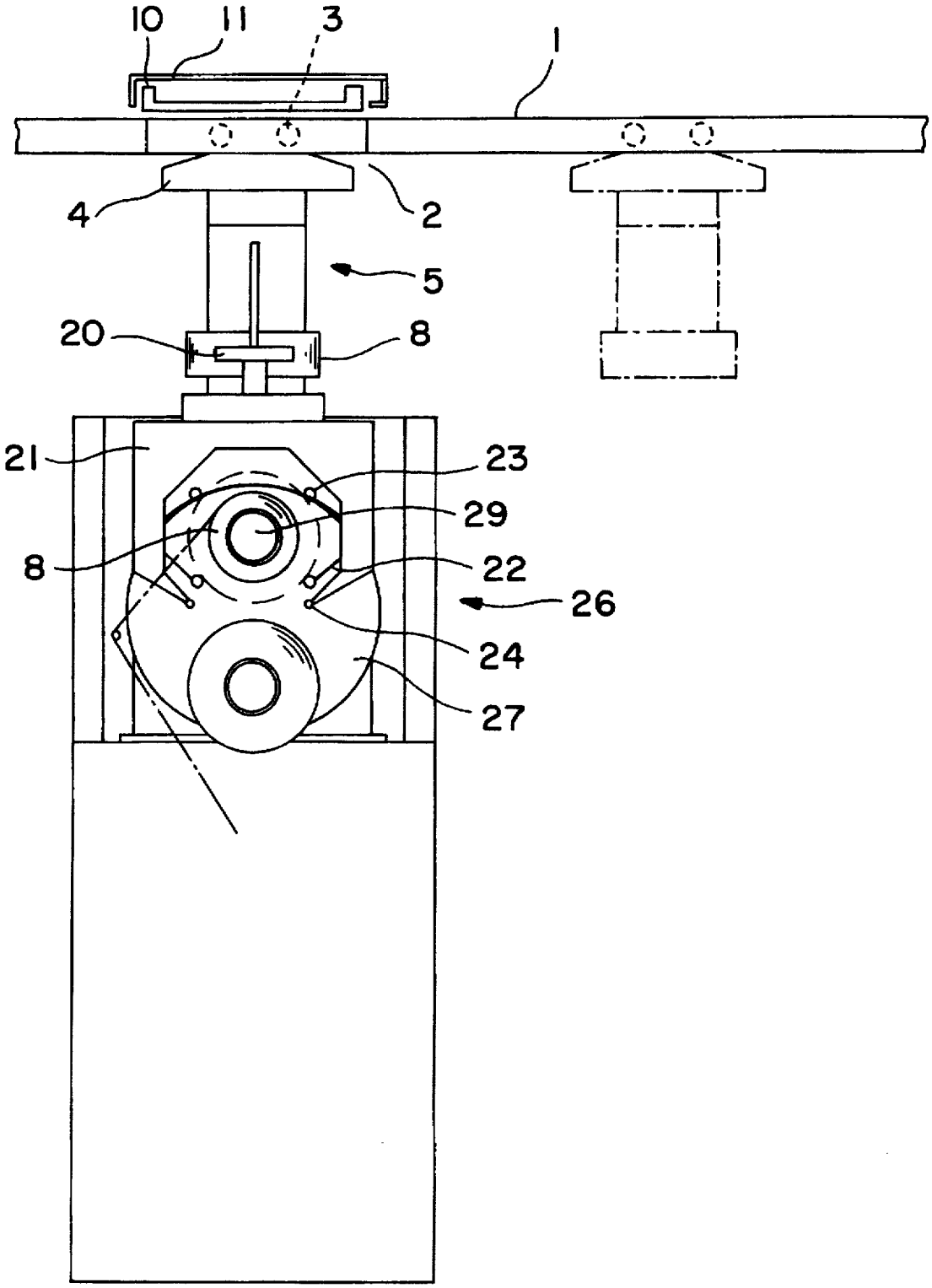
FIG. 1 is a schematic front view of a transfer station in accordance with the present invention in the environment of a packaging machine.

A transfer station in accordance with the present invention is shown in FIG. 1 in combination with a receiving device, associated with a cigarette packaging machine, of the type having two bobbins of packaging material. At the upper portion of FIG. 1, the means for transporting the bobbins to the general vicinity of the packaging machine is shown as an overhead conveyor including a first rail 1, a parallel switching mechanism 2, a trolley 5, and a projection member 4 with rollers 3 for movably supporting trolley 5 from rail 1. Rail 1 is generally U-shaped in cross-section and is typically mounted overhead such that the open end of U-shaped rail 1 opens downwardly. The free ends of the sides of U-shaped rail 1 are bent inwardly at approximately 90° to provide engagement surfaces for rollers 3 of projection member 4. Thus, as trolley 5 is guided along rail 1, rollers 3 roll along the inwardly bent ends of the side arms of rail 1.

Each trolley 5 serves as a bobbin delivery vehicle and is capable of transporting and/or temporarily storing either or both of bobbins 8, having webs of packaging material wound thereon, or exhausted bobbins, i.e., bobbin cores 25. Trolley 5 includes a carrying bow 6 which is attached to projection member 4 and is open on at least one side. Trolley 5 also includes a generally horizontal baseplate 7 for transporting a bobbin 8 lying on one side. Since bobbin 8 will typically be wound with one of a variety of cigarette packaging materials, such as internal paper, external paper or tear-off strip of the transparent film, horizontal transport of bobbin 8 is particularly advantageous.

For simultaneous operation of a plurality of trolleys similar to trolley 5, the overhead conveyor employs parallel switching mechanisms 2. These switching mechanisms consist of two or more generally parallel rails, collectively referred to as sections 9, which are mounted to a carriage 10. Carriage 10, in turn, is movably mounted to a guide 11. While rail 1 provides for movement of trolleys 5 along the length of the rail 1, each parallel switch 2 provides for movement in a direction substantially perpendicular to the travel direction defined by rail 1. Using parallel switch mechanisms 2, the present invention is capable of accommodating simultaneous operation of a plurality of trolleys 5 without the trolleys 5 substantially interfering with one another.

Figure 2:
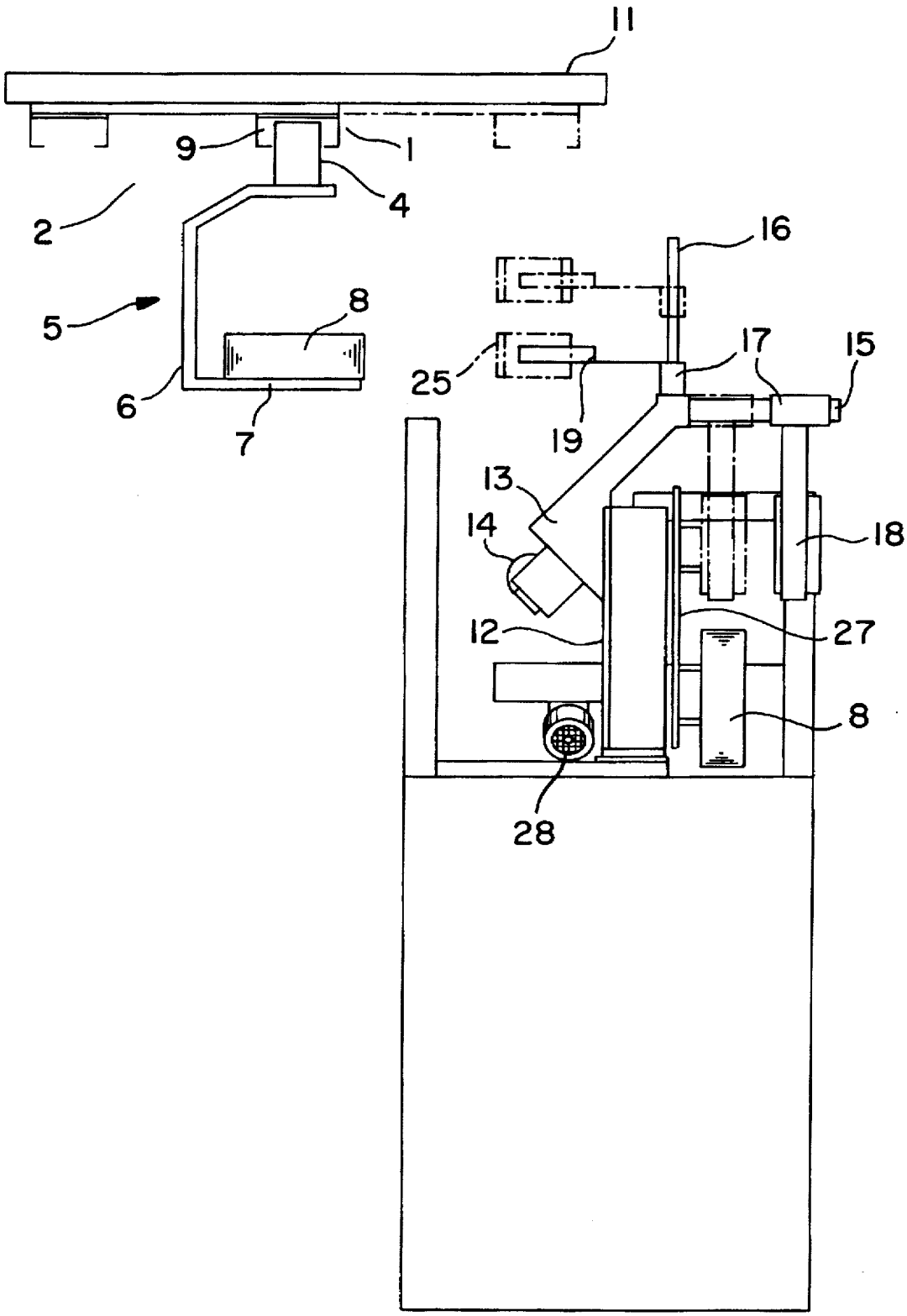
FIG. 2 is a schematic side view of the transfer station depicted in FIG. 1.

The transfer station shown in FIGS. 1 and 2 also includes a chassis 12, a turntable 27 pivotably mounted to chassis 12, an axle 13, which is rotatably mounted on chassis 12, and at least one gripper 18. As shown, axle 13 is mounted on chassis 12 for rotation about an axis which lies in a plane perpendicular to the plane in which the baseplates 7 of trolleys 5 travel. Axle 13 is also oriented at an angle of about 45° to the plane of baseplates 7. One end of axle 13 is connected to a motor 14 for rotating axle 13, and the other end of axle 13 terminates at arms 15 and 16. Arms 15 and 16 extend from axle 13 substantially perpendicular to one another such that, as axle 13 is successively rotated by 180°, arms 15 and 16 successively alternate between vertical and horizontal orientations.

Each of arms 15 and 16 is provided with a linearly displaceable sleeve 17 and a gripper 18 or 19, for gripping bobbins and/or bobbin cores, extending from sleeve 17. A variety of means can be used to impart motion to sleeve 17. These include use of one of a cylinder 20, a ball roller spindle, or a toothed rack and an associated pinion in cooperation with an electric motor or the like. As shown in FIG. 2, the transfer station has a different type gripper on each of arms 15 and 16. Thus, whereas gripper 18 of arm 15 is specially designed for engagement with a full bobbin 8, gripper 19 of arm 16 is specially designed for engagement with a bobbin core 25. This arrangement allows for substantially simultaneous removal of the core 25 of an exhausted bobbin from a receiving device and removal of a full bobbin 8 from baseplate 7 of trolley 5. Accordingly, the overall bobbin exchange time is substantially reduced.

Referring now to FIG. 1, either or both of grippers 18 and 19 can include a gripper frame 21 having two pairs of gripper arms 22 located opposite one another within gripper frame 21. For engaging bobbin 8, gripper arms 22 are moved towards one another into an engagement position wherein rollers 23, located at the ends of gripper arms 22, engage the perimeter of bobbin 8. In an alternative embodiment, rounded portions at the free ends of gripper arms 22 are substituted for rollers 23. Optionally, gripper frame 21 can include an opening at one side thereof which is somewhat smaller than the diameter of a bobbin 8 or bobbin core 25 received therein. Thus, when gripper frame 21 is oriented such that the opening faces downward, a bobbin 8 or bobbin core 25 received within the frame 21 will contact rollers 24 and not fall through the opening. Optionally, either or both of grippers 18 and 19 can employ only two gripper arms 22 instead of two pairs of gripper arms 22. Additionally, if bobbin core 25 is removed from a packaging machine in some manner other than that described above, identical grippers 18 and 19 can be used on arms 15 and 16. Similarly, if grippers 18 and 19 are specially designed so as to be capable of gripping both bobbins 8 and bobbin cores 25, arm 15 and 16 can have identical grippers 18 and 19.

In the disclosed embodiment, the transfer station also includes a turntable 27 mounted to chassis 12. Turntable 27 can be rotated with an electric motor 28 between at least two positions which are about 180° apart relative to one another. As shown, turntable 27 has two diametrically opposed receiving journals 29 for receiving bobbin 8 in a substantially horizontal orientation. Generally, the chassis 12 and turntable 27 are associated with a receiving device, indicated generally at 26 in FIG. 1, of a cigarette packaging machine, a web splicing apparatus, a web dispensing apparatus or any one of the many machines used in the field of product packaging.

Transfer of a bobbin 8 from baseplate 7 of trolley 5 to a receiving device 26 will now be described with reference to the accompanying drawings. Once trolley 5, with bobbin 8 loaded onto baseplate 7 of trolley 5 has been moved into the transfer position on rail 1 of section 9 of a parallel switch mechanism 2, transfer of bobbin 8 can begin. First, gripper 18 moves along the length of arm 15 until it reaches the free end of arm 15. Axle 13 is then caused to rotate about its axis until arm 15, with associated gripper 18 thereon, moves into a vertical position where gripper 18 is located toward the free end of arm 15 and is elevated above bobbin 8. Gripper 18 is then moved down arm 15 until gripper arms 22 of gripper 18 surround bobbin 8. Arms 22 will then converge to firmly engage the perimeter of bobbin 8. The motion of gripper 18 on arm 15 is then reversed to bring the gripper back to its previous elevated position. Axle 13, once again, now rotates approximately 180° until arm 15 reaches a horizontal position. At this point, bobbin 8 is axially aligned with a receiving journal 29 of receiving device 26. Gripper 18 once again moves along arm 15 until bobbin 8 is transferred onto an empty receiving journal 29 whereupon receiving journal 29 is splayed until it bears against bobbin core 25 of bobbin 8. Finally, gripping arms 22 of gripper 18 release bobbin 8 and gripper 18 is retracted again and moved along arm 15 until it cannot interfere with rotation of turntable 27 or the dispensing of packaging material from bobbin 8.

A procedure similar to that described above is employed to remove an exhausted bobbin core 25. First, turntable 27 is rotated such that the receiving journal 29 with bobbin 8 is located immediately below the receiving journal 29 with bobbin core 25. This rotation places bobbin core 25 in position for removal. Axle 13 then rotates 180° so that arm 16 moves into a horizontal position. Gripper 19, which is presently located near the free end of arm 16, is moved along arm 16 toward turntable 27 until gripping arms 22 of gripper 19 surround bobbin core 25. Gripping arms 22 then converge to engage the perimeter of bobbin core 25 and gripper 19 once again moves toward the free end of arm 16. Axle 13 rotates approximately 180° until arm 16 reaches a vertical position and gripper 19 lowers bobbin core 25 onto base plate 7 of trolley 5. Upon release of bobbin core 25 by gripping arms 22 and the raising of gripper 19, trolley 5 is free to traverse the length of rail 1 and prepare for subsequent transport of other bobbins.

A number of alternative embodiments are possible with the present invention. First, a tray for temporary reception of bobbins lying on one side can be provided between the overhead conveyor and the receiving device 26. Additionally, while the use of axle 13 obviates the need for sliding contacts when either one arm or two arms 15 and 16 extend from axle 13, sliding contacts can be substituted for axle 13, if desired. The use of more than two arms extending from axle 13 would require the use of sliding contacts.

While a preferred embodiment and a number of alternatives thereto have been shown and described, various other modifications and substitutions may be made without departing from the spirit and scope of the invention. Accordingly, it is to be understood that the present invention has been described by way of illustration and not limitation.

What is claimed is:

1. Apparatus for transferring bobbins to a bobbin receiving device of a cigarette packaging machine, the bobbins each having an axis of rotation, said apparatus comprising:

a. means for transporting bobbins to a transfer position, said bobbin transporting means including a base plate for supporting at least one bobbin, said base plate defining a bobbin support plane which is generally transverse to the axis of rotation of a bobbin positioned thereon;

b. a chassis;

c. an axle supported on said chassis for rotation about a first axis which lies in a plane which is generally perpendicular to said bobbin support plane, said first axis being oriented at an angle of about 45 degrees to said support plane;

d. at least a first arm extending angularly from said axle, said first arm defining a second axis and being movable in response to rotation of said axle between at least a first position wherein said second axis is generally parallel to the axis of rotation of a bobbin positioned on said base plate and a second position wherein said second axis is generally transverse to the axis of rotation of a bobbin positioned on said base plate;

e. gripping means for engaging a bobbin, said gripping means including a first gripper movably mounted on said first arm and being displaceable along said first arm, said first gripper including gripping arms for gripping a bobbin on the perimeter thereof; and f. a turntable mounted on said chassis for rotation between at least two positions, said turntable including at least two receiving journals for receiving bobbins from said gripping means.

2. The apparatus of claim 1, further comprising a second arm extending angularly from said axle, said second arm defining a third axis, said third axis being substantially perpendicular to said second axis, and wherein said gripping means includes a second gripper movably mounted on said second arm and being displaceable along said second arm, said second gripper including gripping arms for gripping a bobbin on the perimeter thereof.

3. The apparatus of claim 2, wherein said gripping arms are sized and shaped to grip both full bobbins and the cores of empty bobbins.

4. The apparatus of claim 3, wherein said gripping means further comprises a gripper frame, said gripping arms being supported from said gripper frame, said gripper frame defining a bobbin receiver which is open on at least one end, said gripper frame having an opening on one side thereof, said opening having a width which is smaller than the diameter of the bobbins being transferred.

5. The apparatus of claim 4, wherein said transporting means further comprises a parallel switch mechanism located adjacent to said first rail.

6. The apparatus of claim 2, wherein said transporting means includes an overhead conveyor having at least a first rail, and at least one trolley movably mounted to said first rail and wherein said base plate is part of said trolley.

7. The apparatus of claim 1, wherein said gripping arms are sized and shaped to grip both full bobbins and the cores of empty bobbins.

8. The apparatus of claim 7, wherein said transporting means includes an overhead conveyor having at least a first rail, and at least one trolley movably mounted to said first rail and wherein said base plate is part of said trolley.

9. The apparatus of claim 8, wherein said transporting means further comprises a parallel switch mechanism located adjacent to said first rail.

10. The apparatus of claim 1, wherein said gripping means further comprises a gripper frame, said gripper frame defining a bobbin receiver which is open on at least one end, said gripper frame having an opening with a width which is smaller than the diameter of bobbins received therein on one side thereof.

11. The apparatus of claim 10, wherein said transporting means includes an overhead conveyor having at least a first rail, and at least one trolley movably mounted to said first rail and wherein said base plate is part of said trolley.

12. The apparatus of claim 1, wherein said transporting means includes an overhead conveyor having at least a first rail, and at least one trolley movably mounted to said first rail and wherein said base plate is part of said trolley.

13. The apparatus of claim 12, wherein said transporting means further comprises a parallel switch mechanism located adjacent to said first rail.

* * * * *